US011338962B2

(12) United States Patent
Wong et al.

(10) Patent No.: US 11,338,962 B2
(45) Date of Patent: May 24, 2022

(54) BAG CONTAINER WITH SEALING MECHANISM

(71) Applicant: KING'S FLAIR MARKETING LIMITED, Tortola (VG)

(72) Inventors: Siu Wah Wong, Tortola (VG); Tsan Ho Chan, Tortola (VG); William Huang, Tortola (VG); Ho Yan Leung, Tortola (VG)

(73) Assignee: KING'S FLAIR MARKETING LIMITED, Tortola (VG)

( * ) Notice: Subject to any disclaimer, the term of this patent is extended or adjusted under 35 U.S.C. 154(b) by 0 days.

(21) Appl. No.: 17/233,947

(22) Filed: Apr. 19, 2021

(65) Prior Publication Data

US 2022/0097920 A1 Mar. 31, 2022

(30) Foreign Application Priority Data

Sep. 25, 2020 (CN) ..... 202022146993.7

(51) Int. Cl.
*B65D 33/25* (2006.01)

(52) U.S. Cl.
CPC ..... *B65D 33/2541* (2013.01)

(58) Field of Classification Search
CPC ..... B65D 33/2541
USPC ..... 383/63
See application file for complete search history.

(56) References Cited

U.S. PATENT DOCUMENTS

| | | | | |
|---|---|---|---|---|
| 3,280,870 | A * | 10/1966 | Bundy | A45C 13/10 206/526 |
| 3,410,327 | A * | 11/1968 | Ausnit | B65D 33/2541 383/65 |
| 9,371,153 | B1 * | 6/2016 | Nouri | B65D 75/22 |
| 2009/0110335 | A1 * | 4/2009 | LeBoeuf | B65D 81/18 383/63 |
| 2010/0278457 | A1 * | 11/2010 | Greco | B65D 33/2591 383/64 |
| 2011/0069911 | A1 * | 3/2011 | Ackerman | B65D 31/10 383/64 |
| 2018/0251267 | A1 * | 9/2018 | Finell | A47G 19/2205 |
| 2020/0239194 | A1 * | 7/2020 | Yosufy | B65D 33/1683 |
| 2021/0214129 | A1 * | 7/2021 | Woo | B65D 33/2558 |

(Continued)

FOREIGN PATENT DOCUMENTS

WO WO-2014163712 A1 * 10/2014 ..... B65D 33/2541

*Primary Examiner* — Jes F Pascua
(74) *Attorney, Agent, or Firm* — WPAT, PC

(57) ABSTRACT

The invention provides a bag container with a sealing mechanism including first and second container housings to define an open top. The sealing mechanism includes female and male engagement members respectively positioned on the two container housings. The male engagement member includes a body portion and at least a pair of protrusions extending from opposite sides of the body portion and facing away from each other, the protrusions each having opposite first and second side surfaces, and the second side surface extending at an acute angle relative to an orthogonal direction of the longitudinal axis of the male engagement member. The female and male engagement members are sized and shaped for mating engagement to hermetically seal the open top. The invention also provides a sealing mechanism comprising female and male engagement members having mating wavy cross-sectional profiles in a plane parallel to the respective container housings.

11 Claims, 11 Drawing Sheets

(56) References Cited

U.S. PATENT DOCUMENTS

| | | | | |
|---|---|---|---|---|
| 2021/0245920 | A1* | 8/2021 | Maguire | B65D 11/188 |
| 2021/0245932 | A1* | 8/2021 | Maguire | B65D 33/2541 |

* cited by examiner

BAG CONTAINER WITH SEALING MECHANISM

FIELD OF THE INVENTION

The invention relates to a bag container with a sealing mechanism, more specifically, relates to an integrally molded bag container, which has an integrated sealing mechanism to provide sealing and leakproof functions.

BACKGROUND OF THE INVENTION

Bag containers with a sealing mechanism, such as sealed bags, are known in the prior art. Due to the difference in materials and the disparity in designs of the sealing mechanism, the sealed bags of the prior art suffer from various problems, for example, they are not adapted for repeated use due to poor durability, the materials are not resistant to cold/heat, it is inconvenient to clean the bags by dishwashers, the open tops are difficult to be completely sealed, the leakage of the sealing mechanism is problematic, or the manufacturing process is complicated and not prone to one pot molding and the like.

Accordingly, the present invention is proposed to modify the existing sealed bags, in order to strengthen the sealing effect of the sealed bags, but also simplify the manufacturing process of the sealed bags.

SUMMARY OF THE INVENTION

In order to solve the above-mentioned problems in the prior art, the present invention provides a bag container with a novel sealing mechanism, which can be manufactured by integral molding, has good sealing performance, and is easy to operate and suitable for repeated use.

According to one aspect of the present invention, there is provided a bag container with a sealing mechanism, comprising a container body having a closable open top, a first container housing and a second container housing arranged opposite to the first container housing, each of the first container housing and the second container housing comprising a bottom edge and two side edges, wherein the first container housing is connected to the second container housing along the bottom edge and the two side edges to define an internal volume and the open top of the bag container, and a sealing mechanism provided atop the container body, comprising a female engagement member positioned at an inner surface of an upper portion of one of the first container housing and the second container housing, and a male engagement member positioned at an inner surface of an upper portion of the other, wherein each of the female engagement member and the male engagement member is configured to extend an entire length of the inner surface of the upper portion of the respective container housing, wherein the male engagement member comprises a body portion protruding outwardly from the inner surface of the upper portion of the container housing where the male engagement member is positioned, and at least a pair of protrusions extending from opposite sides of the body portion and facing away from each other, wherein the body portion has a head, and each of the pair of protrusions has a first side surface facing the head and a second side surface opposite to the first side surface and away from the head, the second side surface extends at an acute angle with respect to an orthogonal direction perpendicular to a longitudinal axis of the male engagement member, and the female engagement member is shaped and sized to matingly engage with the male engagement member, so that the upper portions of the first container housing and the second container housing are hermetically engageable with each other to seal the open top of the container body.

The second side surface of the protrusion extends toward or away from the head of the body portion at an acute angle with respect to the orthogonal direction. According to a preferred embodiment of the present invention, the second side surface of the protrusion extends toward the head of the body portion at an acute angle with respect to the orthogonal direction.

Preferably, the second side surface of the protrusion extends with respect to the orthogonal direction at the acute angle of 10°-30°, preferably selected from the group consisting of 10°, 15°, 18°, 20° and 22°. In addition, the first side surface of the protrusion extends away from the head of the body portion at an acute angle with respect to the orthogonal direction, so as to facilitate insertion of the male engagement member into the female engagement member for engagement.

One of the features of the present invention lies in the shape of the male engagement member. Specifically, the male engagement member comprises a body portion and protrusions extending from both sides of the body portion. Since the first side surface and the second side surface of each of the protrusions are configured to have respective acute angles relative to the orthogonal direction of the longitudinal axis of the male engagement member, the shape of the protrusion has a proneness to molding and processing. Furthermore, it is the inventor's finding that the male engagement member and the acute-angled shape of the protrusions allow for applied pressure to close the sealing mechanism with an excellent sealing effect achieved, which prevents from leakage of the liquid in the container to the outside of the container. The sealing mechanism of the invention is easy to open and reclosable.

In a preferred embodiment of the present invention, the bag container is made of a material comprising silicone or rubber. Silicone is a non-toxic polymer material that is resistant to high and low temperatures and is moldable and processable. The bag container made of silicone or rubber is suitable for food storage.

The bag container according to the present invention may be molded integrally. Preferably, each of the two side edges of the first container housing and the second container housing consists of an integral molding portion and an unbonded portion. The integral molding portion extends from the bottom edge to between ⅖ and 9/10 of an overall height of the bag container. The first and second container housings are molded along the integral molding portions thereof in the molding process, and then are hermetically connected by bonding of the unbonded portions thereof after the bag container is formed and demolded. The bonding comprises adhesion of the unbonded portions by an adhesive or hot melt treatment of the unbonded portions.

With the above features, the bag container of the present invention may be molded to define a relatively larger opening to ease processing and demolding of the container. The bonding can also be easily accomplished by any methods known in the art, with the result that the open top of the bag container is completely sealed by the sealing mechanism to ensure sealability of the bag container.

In another preferred embodiment of the invention, the body portion of the male engagement member has at least one wavy section having a wavy cross-sectional profile in a plane parallel to the container housing of the male engagement member, the cross-sectional profile comprising at least one peak or valley in a length direction of the body portion, and the female engagement member has at least one wavy section configured to be matingly engageable with the wavy section of the male engagement member for hermetical engagement therebetween. Preferably, the cross-sectional profile consists of a series of arcuate peaks between arcuate valleys to define the wavy cross-sectional profile. The cross-sectional profile consists of a series of arcuate peaks between arcuate valleys to define the wavy cross-sectional profile. The peak or the valley has a substantially triangular profile. Preferably, the wavy section extends the entire length of the body portion.

Another aspect of the present invention provides a bag container with a sealing mechanism, comprising a container body having a closable open top, a first container housing and a second container housing arranged opposite to the first container housing, each of the first container housing and the second container housing comprising a bottom edge and two side edges, wherein the first container housing is connected to the second container housing along the bottom edge and the two side edges to define an internal volume and the open top of the bag container, and a sealing mechanism provided atop the container body, comprising a female engagement member positioned at an inner surface of an upper portion of one of the first container housing and the second container housing, and a male engagement member positioned at an inner surface of an upper portion of the other, wherein each of the female engagement member and the male engagement member is configured to extend an entire length of the inner surface of the upper portion of the respective container housing, wherein the male engagement member comprises a body portion protruding outwardly from the inner surface of the upper portion of the container housing where the male engagement member is positioned, and the body portion of the male engagement member has at least one wavy section having a wavy cross-sectional profile in a first plane parallel to the container housing of the male engagement member, the cross-sectional profile comprising at least one peak or valley in a length direction of the body portion, and the female engagement member is shaped and sized to be matingly engageable with the male engagement member so that the upper portions of the first container housing and the second container housing are hermetically engageable with each other to seal the open top of the container body.

In a preferred embodiment of the invention, the body portion has a substantially triangular profile in a second plane which comprises a longitudinal axis of the male engagement member and which is perpendicular to the first plane; and the substantially triangular profile may have straight sides. In another preferred embodiment of the invention, the body portion has a head at its outer end, and the head and the body portion together form a T-shaped member having a substantially T-shaped profile in the second plane which comprises the longitudinal axis of the male engagement member and which is perpendicular to the first plane. The head has a chamfered outer side surface and an inner side surface extending at an acute angle with respect to the longitudinal axis of the male engagement member.

The thickness of the container housing is the wall thickness of the bag container, and it can be appropriately selected depending on the volume of the container. The larger the volume, the greater the wall thickness of the container may have, which would make the container less likely to crack.

According to a preferred embodiment of the present invention, the bag container further comprises a grip portion at the top thereof to facilitate opening and closing of the container.

DETAILED DESCRIPTION OF THE INVENTION

Figure 1:
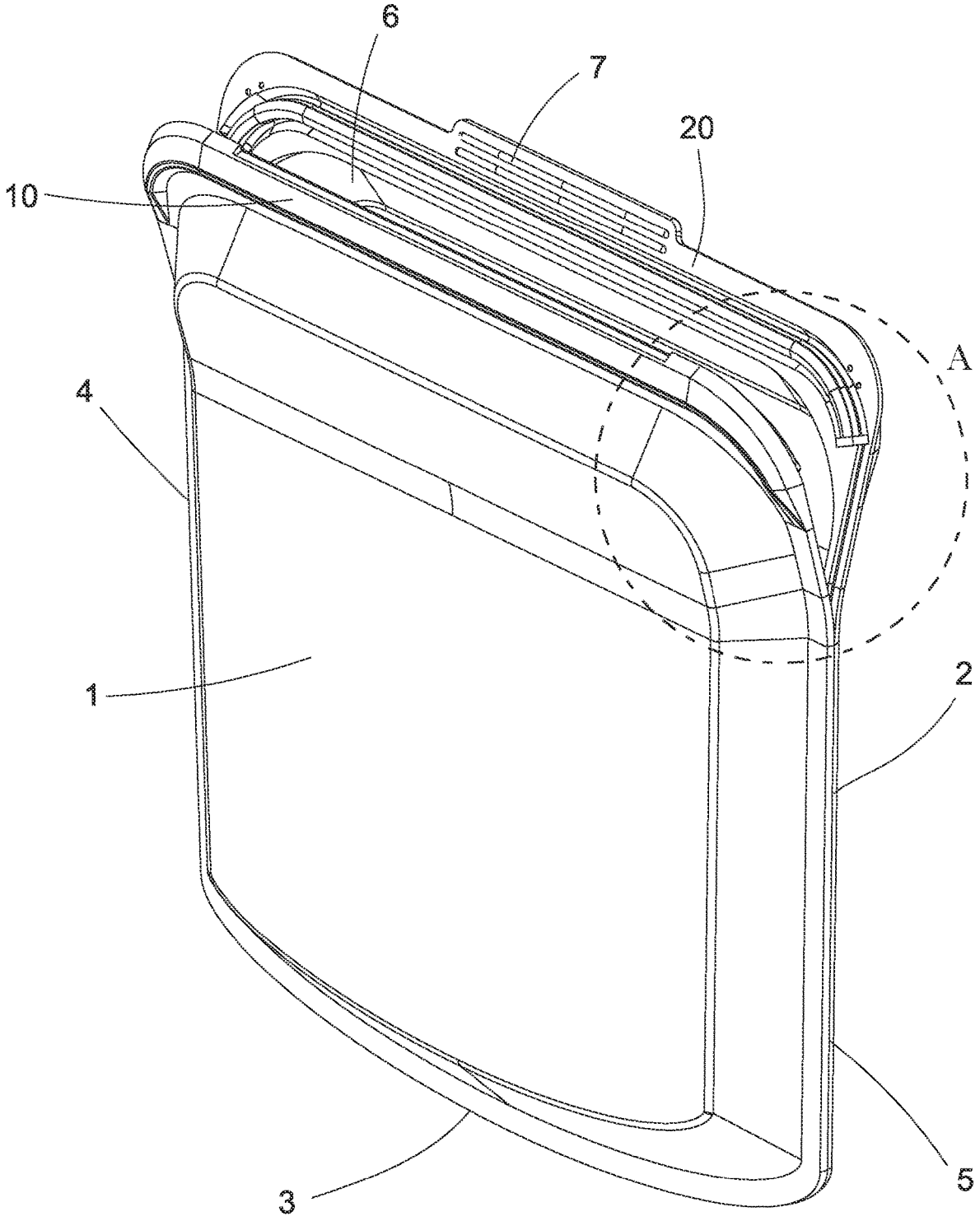
FIG. 1 is a schematic view of a bag container constructed according to a first embodiment of the present invention, wherein the bag container is molded with its unbonded portions of the two side edges adjacent to the open top ready for bonding.
Figure 2:
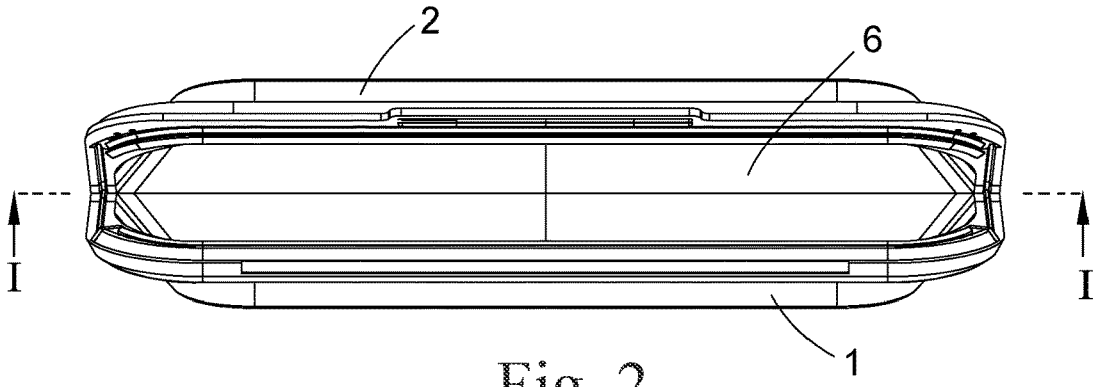
FIG. 2 is a top view of the bag container shown in FIG. 1.

Although preferred embodiments of the present invention are illustrated and described herein, the bag container may be manufactured in many different configurations, sizes, and materials.

Exemplary embodiments of the bag containers with a sealing mechanism of the present invention will be described with reference to the drawings. It should be understood that various parts in the drawings are not necessarily drawn to scale, but are merely illustrative, and they do not represent the real dimensions of the product of the present invention.

Referring to FIGS. 1 to 7, there is illustrated a bag container constructed according to a first embodiment of the present invention. As shown in FIG. 1, the bag container comprises a container body comprising a first container housing 1 and a second container housing 2 arranged opposite to the first container housing 1. The bag container further comprises a bottom 3 formed by hermetical connection of bottom edges of the first container housing 1 and the second container housing 2. The first container housing 1 and the second container housing 2 are also hermetically connected along their respective side edges to define two sides 4 and 5 of the bag container. Therefore an internal volume and an open top 6 of the bag container are created. The bag container also comprises a grip portion 7 provided at the top 6 to provide ease of implementing opening and closing of the container.

Figure 3:
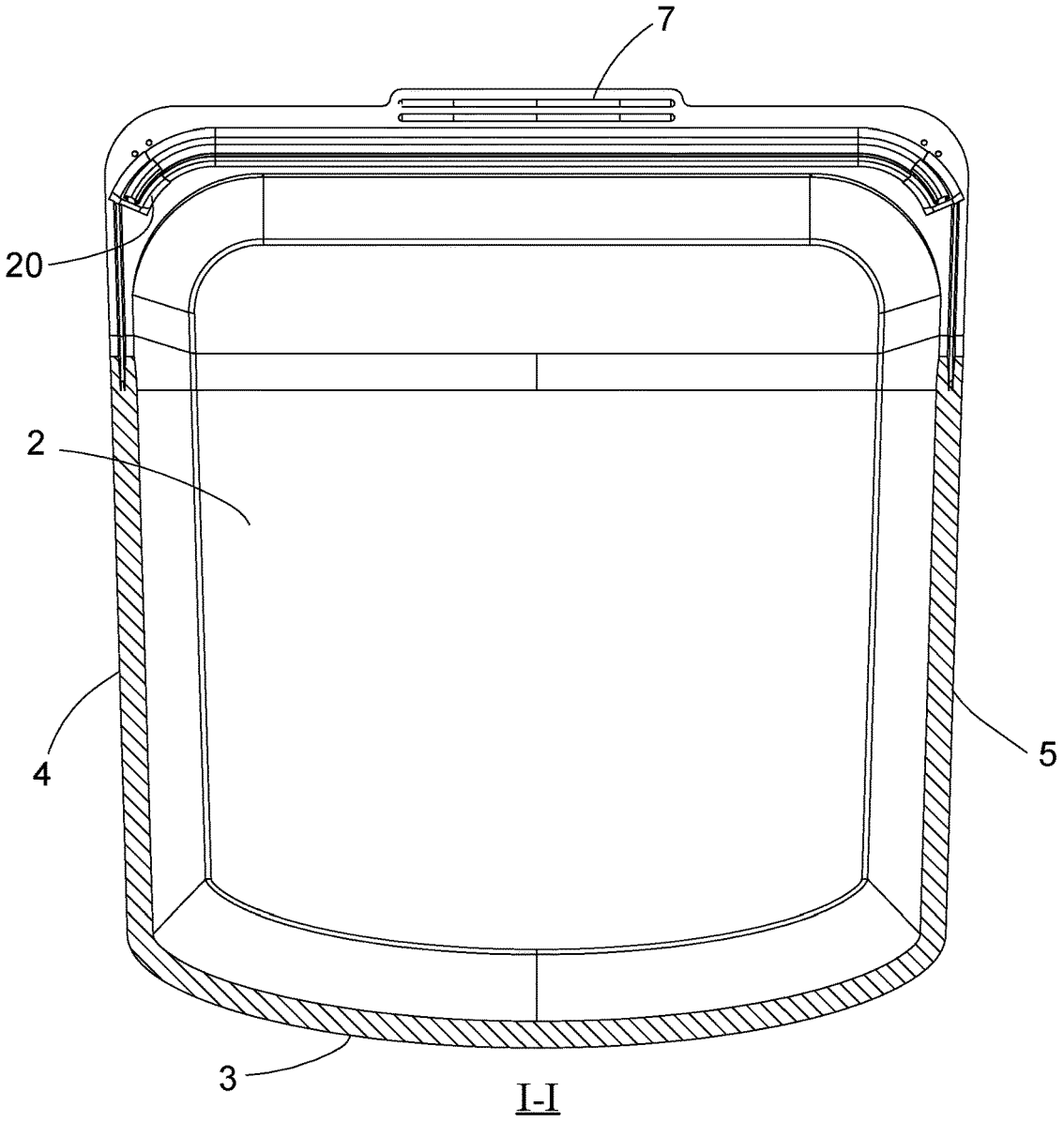
FIG. 3 is a cross-sectional view of FIG. 2 taken along line I-I.
Figure 5:
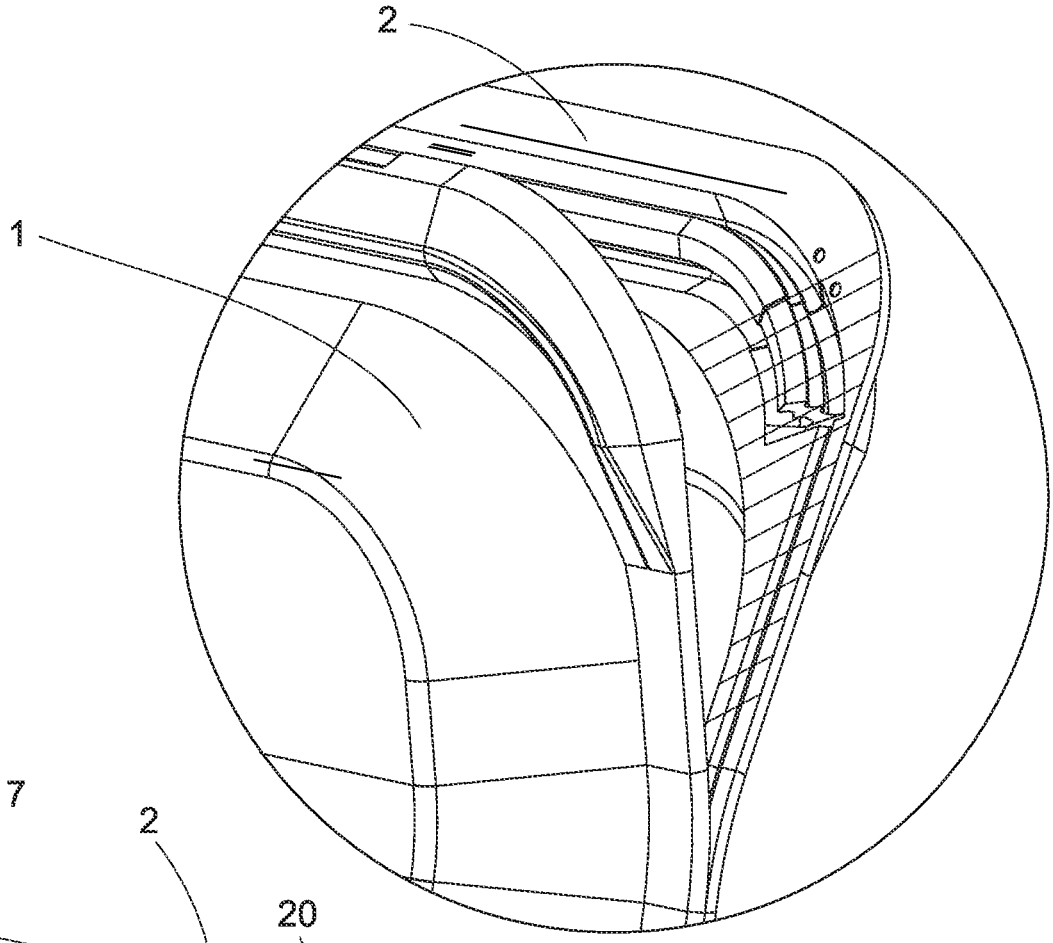
FIG. 5 shows an enlarged schematic view of Part B of FIG. 4.
Figure 4:
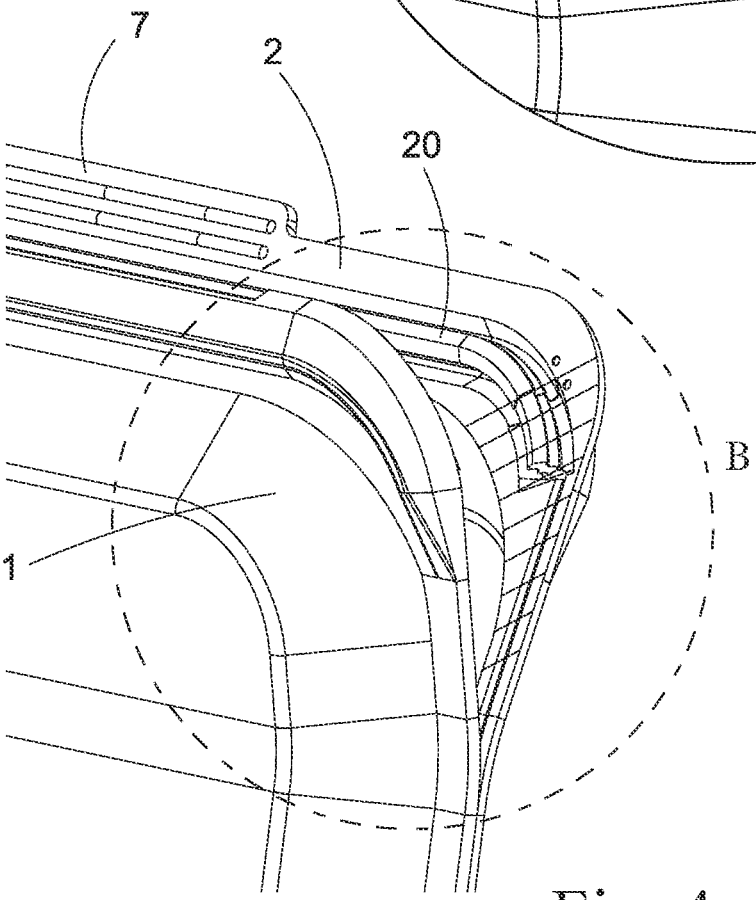
FIG. 4 shows an enlarged schematic view of Part A of FIG. 1, illustrating an area ready for bonding.

The bag container shown in FIG. 1 is molded integrally and has a substantially rectangular outer contour. As shown in FIGS. 1 and 3, the first container housing 1 and the second container housing 2 are integrally molded along their side edges from their bottom edges to more than half of the overall height of the bag container. Preferably, depending on the sizes and types of the bag container, the integral molding portion of the side edge extends from the bottom edge to between ⅖ and 9/10, preferably ½ and ⅘, of the overall height of the container body. The "overall height of the container body" herein refers to the height of the container body of the bag container, that is, the height from the bottom 3 to the top 6 of the bag container.

The bag container shown in FIG. 1 is a molded part, with upper portions of the two side edges in the vicinity of the open top 6 remaining unbonded. As illustrated, the upper portions of the corresponding two side edges of the first container housing 1 and the second container housing 2 are yet to bond. The advantages of this design include provision of the bag container with a relatively large opening, which not only facilitates the integral molding of manufacturing the bag container, but also ease the demolding of the bag container from the mold. After the bag container is formed and demolded, the first container housing 1 and the second container housing 2 are hermetically connected by bonding the unbonded upper portions of the side edges (see the shading area shown in FIG. 4). The bonding treatment may comprise using an adhesive or hot melt treatment. Depending on applications of the bag container, suitable adhesives are chosen to meet relevant safety standards. The hot melt treatment is performed under the conditions chosen to be suitable for the material of the bag container.

FIGS. 4 to 7 show an exemplary sealing mechanism of the bag container, which is arranged on the top of the container body. In this embodiment, the sealing mechanism comprises a female engagement member 10 located on the first container housing 1 and a male engagement member 20 located on the second container housing 2. As shown in FIG. 1, the female engagement member 10 and the male engagement member 20 are configured to extend the entire transverse length of the inner surfaces of the upper portions of the first container housing 1 and the second container housing 2, respectively. After the unbonded portions of the side edges of the two container housings 1 and 2 are bonded together, the open top 6 of the bag container is formed with the sealing mechanism which spans the entire opening length thereof because the end portions of the male engagement member 20 are in engagement with the respective end portions of the female engagement member 10. This ensures the sealability of the bag container. The female engagement member 10 and the male engagement member 20 are clearly shown in FIGS. 6A, 6B and 7 in cross-sectional views.

The male engagement member 20 comprises a body portion 21 that protrudes outwardly from and perpendicular to the inner surface of the upper portion of the second container housing 2, and two pairs of protrusions 22, 23, 24 and 25 extending from opposite sides of the body portion 21 and facing away from each other. The body portion 21 has a head 211, and the protrusions 22, 23, 24 and 25 each have a first side surface 221, 231, 241 and 251 facing the head 211, and a second side surface 222, 232, 242 and 252 opposite to the first side surface and away from the head 211. The longitudinal axis Y of the male engagement member 20 is defined to extend from the inner surface of the upper portion of the second container housing 2 to the head 211 of the body portion 21, and an orthogonal direction is defined herein to refer to a direction perpendicular to the longitudinal axis Y of the male engagement member 20. The second side surfaces 222, 232, 242, and 252 of the protrusions 22, 23, 24, and 25 respectively extend toward the head 211 at an acute angle with respect to the orthogonal axes Z1 and Z2.

Figure 6A:
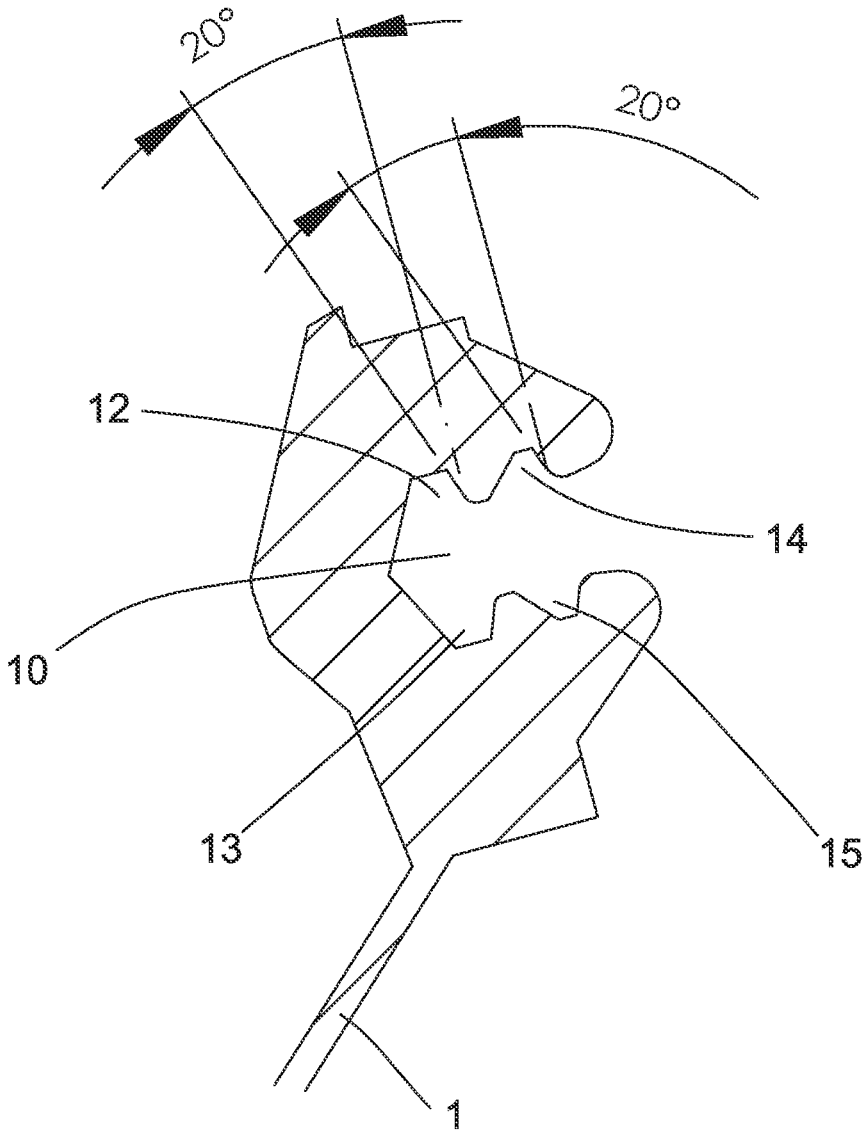
FIGS. 6A and 6B are respective schematic cross-sectional views of female engagement member and male engagement member of a sealing mechanism of the bag container shown in FIG. 1.
Figure 6B:
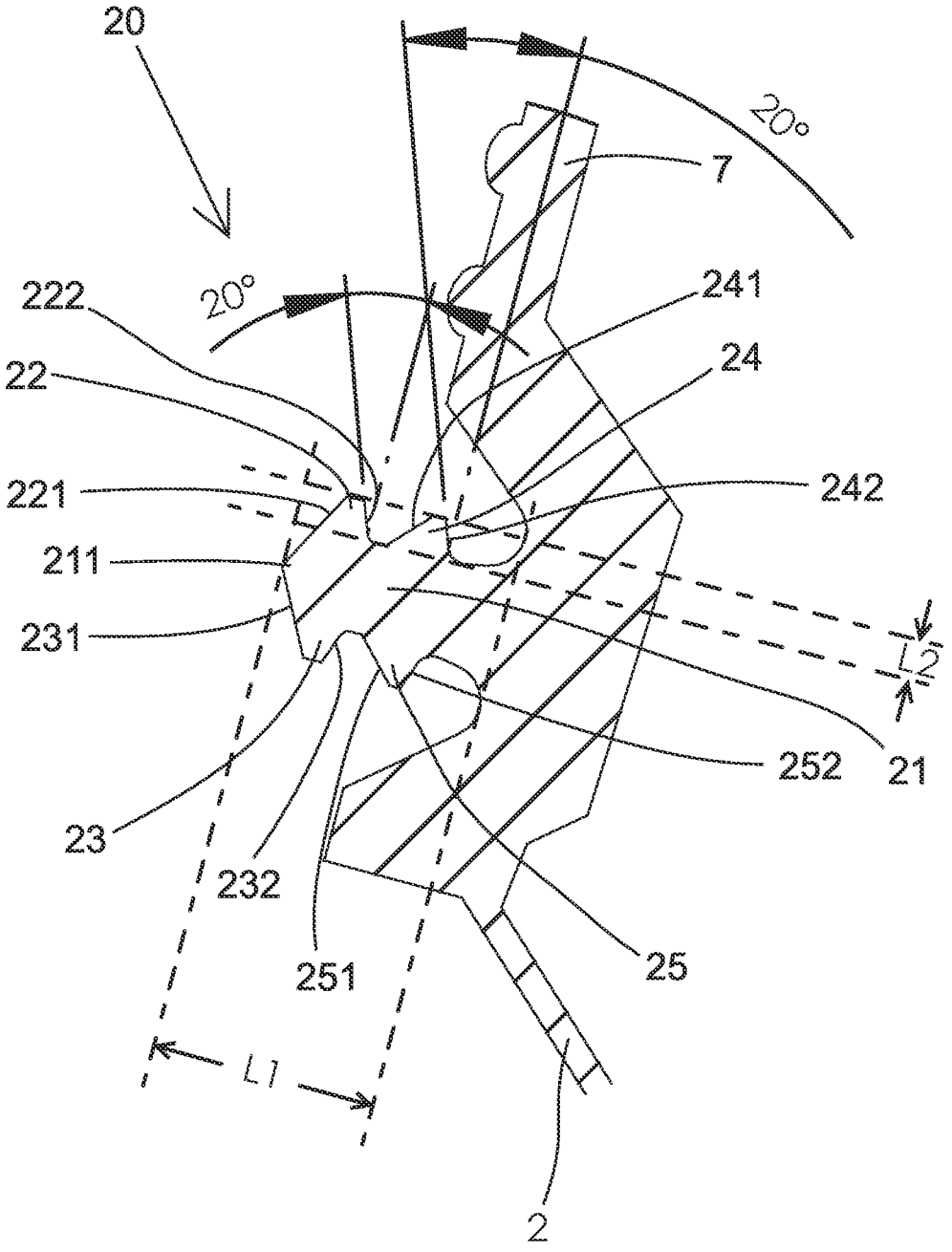
Figure 7:
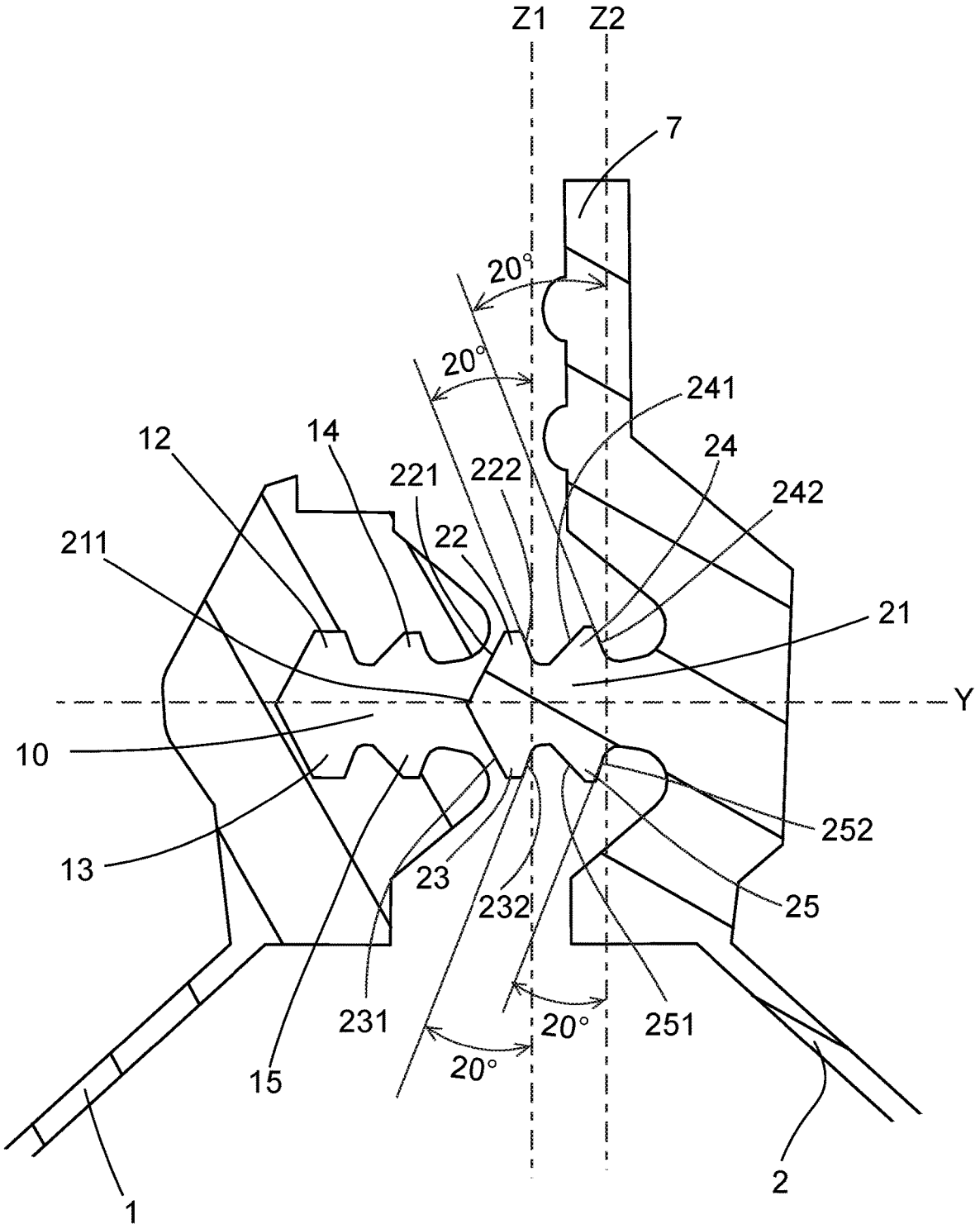
FIG. 7 is a schematic view of the female engagement member and the male engagement member shown in FIGS. 6A and 6B which are ready to engage with each other.

The open top of the bag container is open upward in FIGS. 6A, 6B and 7, with the first container housing 1 on the left and the second container housing 2 on the right, and the male engagement member 20 protruding leftwards from and perpendicular to the inner surface of the upper portion of the second container housing 2. The second side surfaces 222 and 242 of the protrusions 22 and 24 located above the body portion 21 extend upwardly in a direction toward the head 211 at an acute angle with respect to the orthogonal axes Z1 and Z2, respectively. The acute angle of upward extension is in the range of 10°-30°, preferably selected from the group consisting of 10°, 15°, 18°, 20° and 22°, and most preferably 20°. The second side surfaces 232 and 252 of the protrusions 23 and 25 located beneath the body portion 21 extend downwardly in a direction toward the head 211 at an acute angle with respect to the orthogonal axes Z1 and Z2, respectively. The acute angle of downward extension is in the range of 10°-30°, preferably selected from the group consisting of 10°, 15°, 18°, 20° and 22°, and most preferably 20°.

It would be understandable that the second side surfaces 222 and 242 may be configured to respectively extend upwardly away from the head 211 of the body portion, and the second side surfaces 232 and 252 may be configured to respectively extend downwardly away from the head 211 of the body portion. The male engagement member of such configuration can achieve the same sealing effect.

The first side surfaces 221 and 231 of the protrusions 22 and 23 first come into contact with the female engagement member 10 when the male engagement member 20 is advanced to get engaged with the female engagement member 10, and therefore they are advantageously configured to facilitate insertion of the male engagement member 20. In the illustrated embodiment, the first side surfaces 221 and 231 respectively extend at an acute angle with respect to the orthogonal axis Z1 upwardly or downwardly away from the head 211 of the body portion in a direction of having a tendency to converge the corresponding second side surfaces 222 and 232. The head 211 defined by the first side surfaces 221 and 231 is an awl head for easy insertion into the female engagement member 10. Advantageously, the first side surfaces 241 and 251 of the protrusions 24 and 25 respectively extend at an acute angle with respect to the orthogonal axis Z2 upwardly or downwardly away from the head 211 of the body portion in a direction of having a tendency to converge the corresponding second side surfaces 242 and 252. The first side surfaces 241 and 251 together define an awl middle section of the body portion 21 for facilitating advancement of the male engagement member 20 into the female engagement member 10.

The first pair of protrusions 22 and 23 that adjoin the head 211 of the male engagement member 20 and the second pair of protrusions 24 and 25 may have identical or different configurations, as long as they enable the insertion of the male engagement member 20 into the female engagement member 10 and the molding of the bag container with ease.

Accordingly, the female engagement member 10 is shaped to matingly receive and hermetically engage the male engagement member 20. FIGS. 6A, 6B and 7 clearly show that the female engagement member 10 is configured to comprise notches 12, 13, 14 and 15 for receiving the protrusions 22, 23, 24, and 25 of the male engagement member 20, respectively. Each of these notches 12, 13, 14 and 15 extends at an acute angle in the range of 10°-30° with respect to the orthogonal direction of the longitudinal axis of the female engagement member 10, and the acute angle being formed in correspondence with the second side surface 222, 232, 242, and 252 of the respective protrusion 22, 23, 24 and 25. Upon full insertion of the male engagement member 20 with the protrusions 22, 23, 24 and 25 thereof into the female engagement member 10, a press-fit engagement is created such that the upper portions of the first container housing 1 and the second container housing 2 are in hermetical engagement, thereby achieving the sealing of the bag container.

One of the features of the invention is the male engagement member 20 and the shape of its protrusions 22, 23, 24 and 25. Since the first side surfaces and the second side surfaces (especially the second side surfaces) of the protrusion 22, 23, 24 and 25 are configured to lie at an acute angle relative to the orthogonal axes Z1 and Z2 perpendicular to the longitudinal axis Y of the male engagement member 20, the shapes of the protrusions 22, 23, 24 and 25 are prone to molding and processing. Moreover, the angled design of the two side surfaces of each of the protrusions 22, 23, 24 and 25 allows for matingly deflectable press-fitted engagement of the male engagement member 20 with the female engagement member 10, so as to prevent leakage of contents stored in the container to the outside of the container and also prevent permeation of ambient air into the interior of the container. Therefore the bag container of the invention exhibits an excellent sealing effect. In addition, the shape of the two side surfaces of the protrusions 22, 23, 24 and 25 permits to hermetically close the sealing mechanism by pressing effortlessly.

Figure 8A:
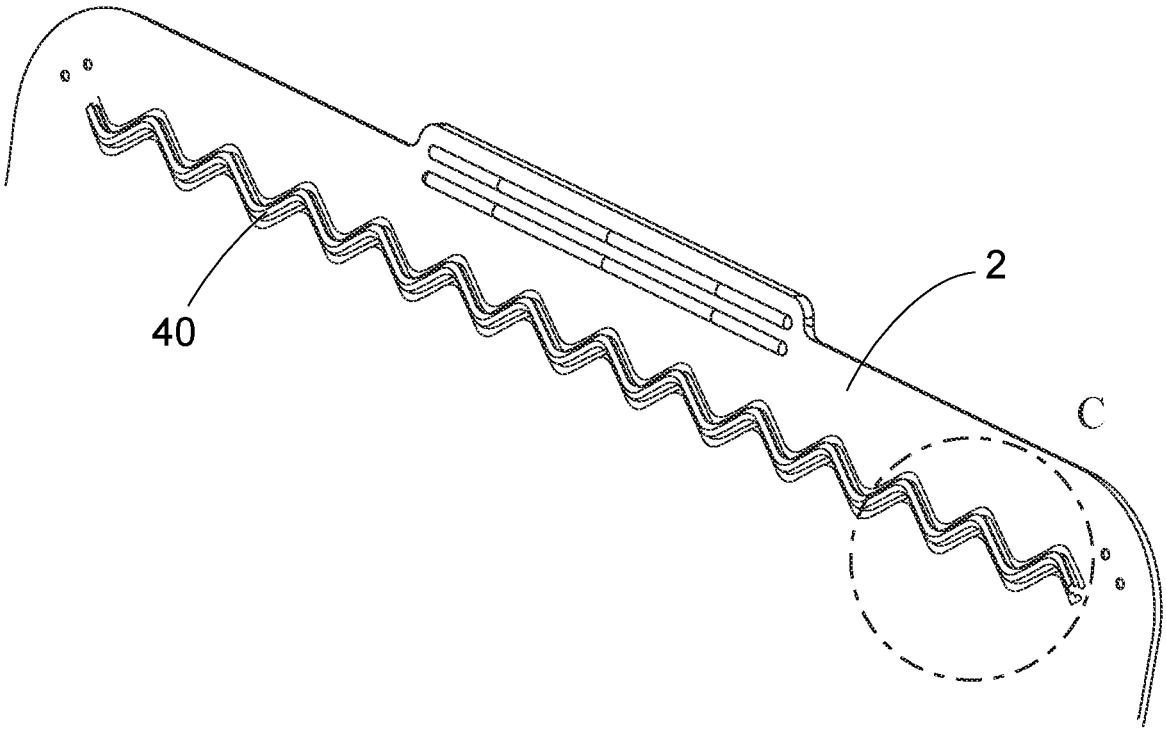
FIGS. 8A and 8B respectively show schematic perspective views of a wavy male engagement member and a wavy female engagement member formed on the two container housings of the bag container constructed according to a second embodiment of the present invention.
Figure 8B:
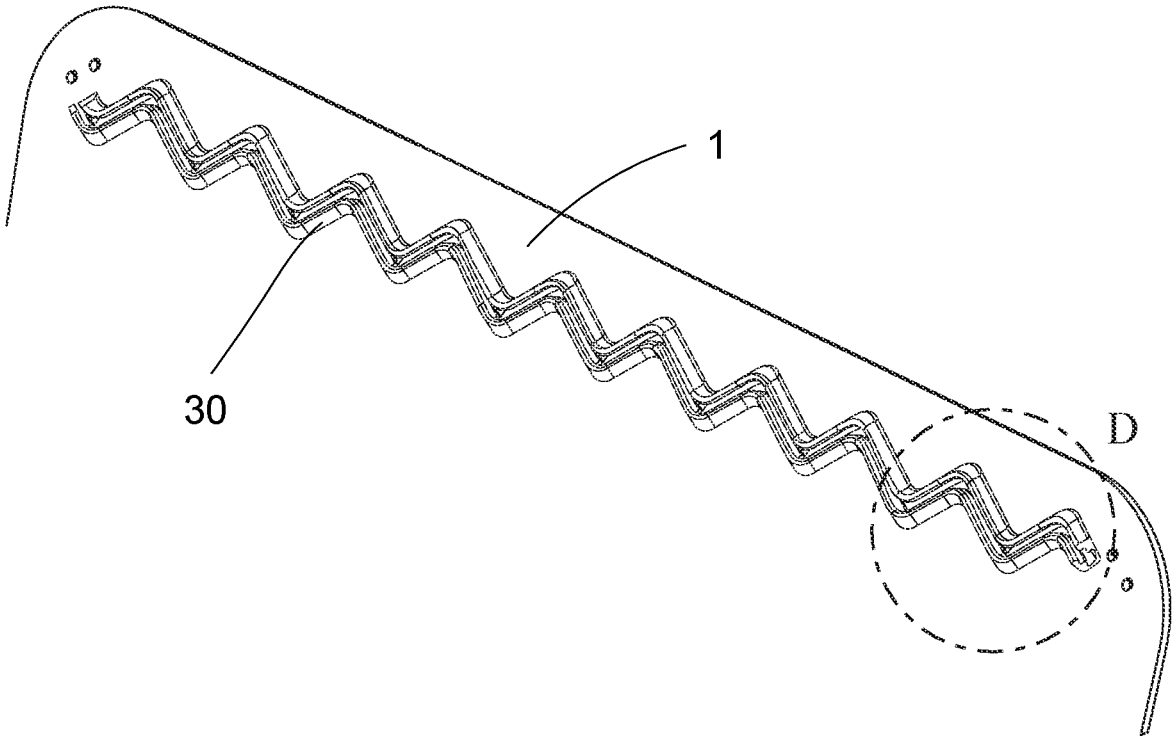

Now turning to FIGS. 8A and 8B, there is illustrated a sealing mechanism of the bag container constructed according to the second embodiment of the present invention. The sealing mechanism of this embodiment is structurally same as the sealing mechanism of the above-discussed first embodiment except that each of the body portions of the male engagement member and the female engagement member follows a zig-zag path in length direction thereof. In this embodiment, a compound wave pattern is incorporated into the sealing mechanism, and the configuration of the wavy male engagement member and the wavy female engagement member maintains a better sealed lock on the first container housing and the second container housing after engagement.

Figure 10:
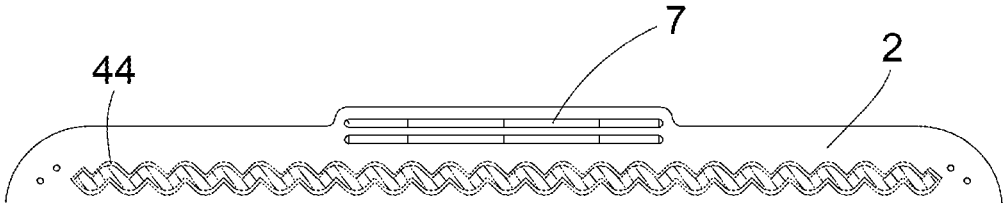
FIG. 10 is a schematic cross-sectional view of the wavy male engagement member of FIG. 8A.
Figure 11:
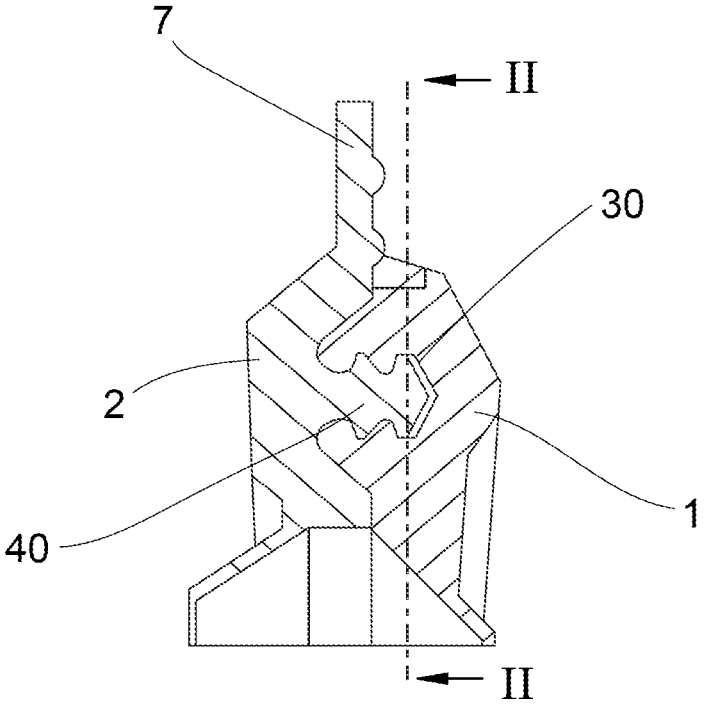
FIG. 11 is a schematic cross-sectional view of the wavy male engagement member and the wavy female engagement member shown in FIGS. 8A and 8B, which are in engagement.

Specifically, the sealing mechanism of this embodiment comprises a wavy female engagement member 30 on the first container housing 1 and a wavy male engagement member 40 on the second container housing 2. The wavy female engagement member 30 and the wavy male engagement member 40 extend the entire transverse length of the inner surfaces of the upper portions of the first container housing 1 and the second container housing 2 and follow a zig-zag path in the entire transverse length, respectively. FIG. 10 is a cross-sectional view taken from II-II shown in FIG. 11, illustrating the wavy male engagement member 40 has a wavy cross-sectional profile in a plane parallel to the second container housing 2. The profile consists of a series of contiguous alternating peaks 41 and valleys 42. Each peak 41 or valley 42 has a substantially isosceles triangular profile having straight sides 43 and a peak 44 that defines the maximum height of the body portion of the wavy male engagement member 40. The base and height of the isosceles triangle may be between 10-30 mm, for example 20 mm. Alternatively, the peaks 41 and the valleys 42 may be formed as arcuate peaks and arcuate valleys, respectively.

Figure 9A:
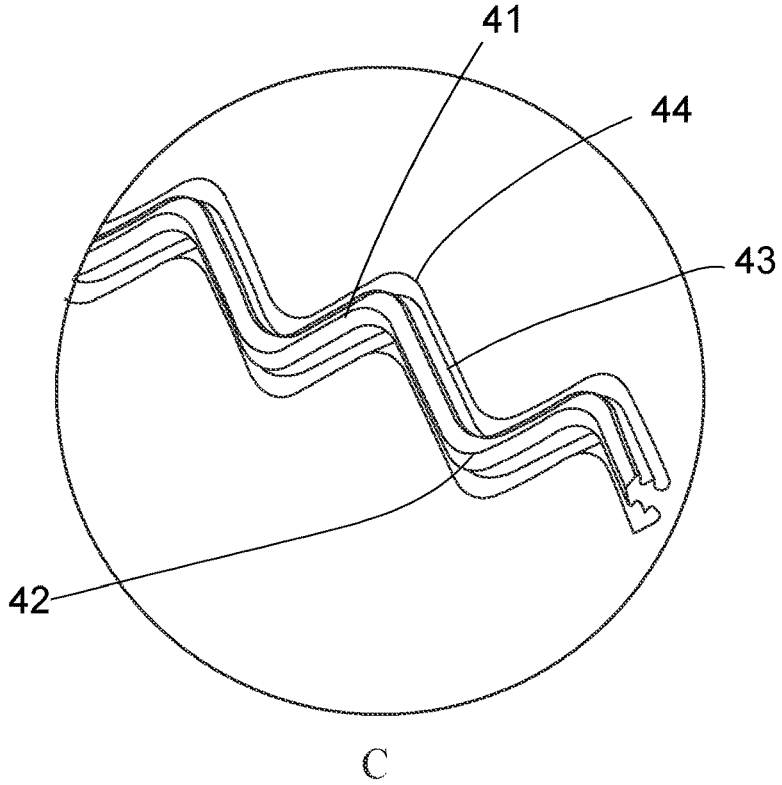
FIGS. 9A and 9B respectively show enlarged schematic views of Part C of FIG. 8A and Part D of FIG. 8B.
Figure 9B:
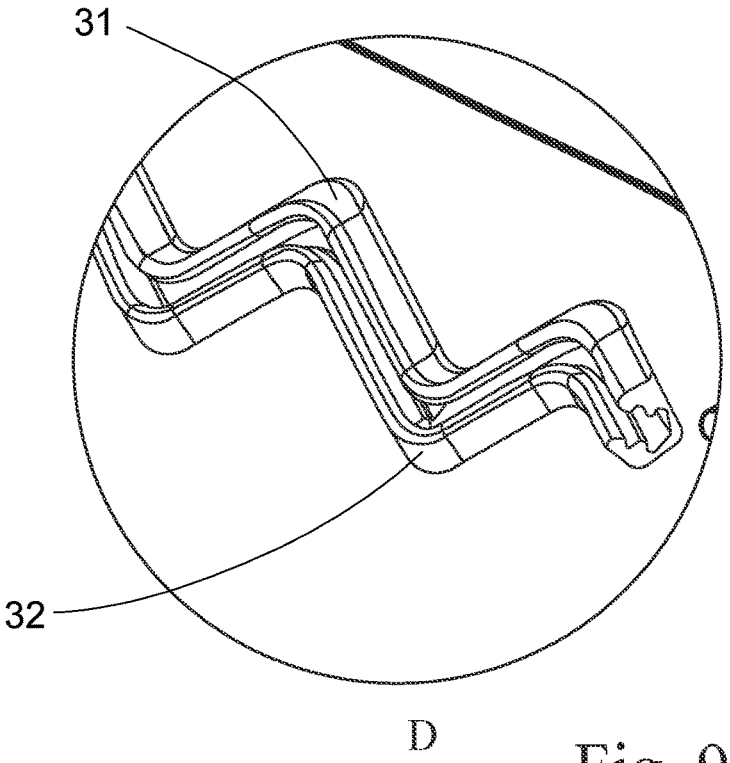

Accordingly, the female engagement member 30 is shaped to be matingly engageable with the male engagement member 40, and has a cross-sectional profile in a plane parallel to the first container housing 1. The cross-sectional profile of the female engagement member 30 consists of a series of continuous alternating peaks 31 and valleys 32 (see FIG. 8B and FIG. 9B). These peaks 31 and valleys 32 define a wavy profile to matingly receive and hermetically engage the wavy male engagement member 40, as shown in FIG. 11.

Similar to the shape of the protrusions discussed in the above first embodiment, the protrusions of the male engagement member 40 of the sealing mechanism according to the second embodiment of the present invention are configured to have two opposite and angled side surfaces. The male engagement member 40 is further characterized by a wavy body portion. The wavy design is found to reduce displacement between the male and female engagement members for creation of a better seal and also to yield better retention of the male engagement member within the female engagement member after the wavy body portion of the male engagement member is pressed into the wavy body portion of the female engagement member.

Figure 12A:
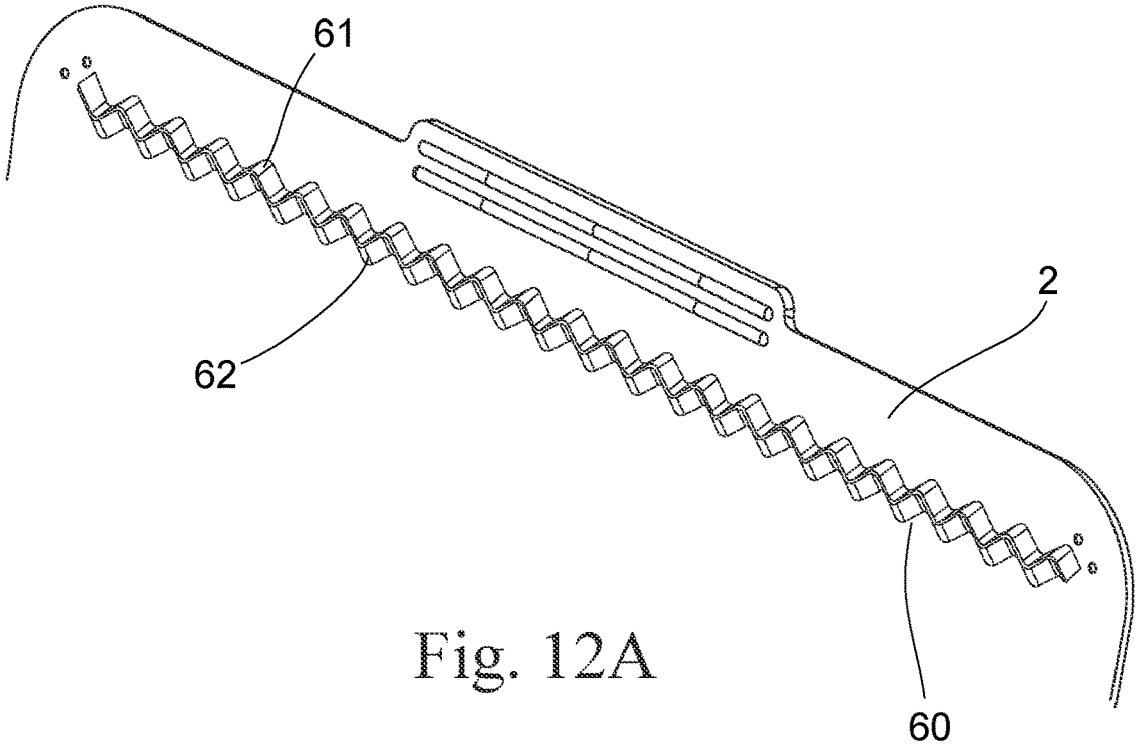
FIG. 12A is a schematic perspective view of an alternative embodiment of the wavy male engagement member of FIG. 8A.
Figure 12B:
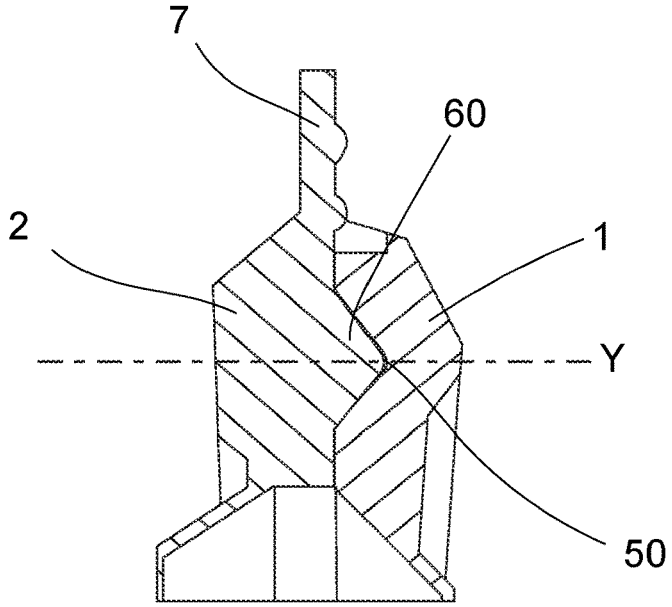
FIG. 12B is a schematic cross-sectional view of the alternative wavy male engagement member shown in FIG. 12A in engagement with its corresponding wavy female engagement member.

FIGS. 12A and 12B illustrate a male engagement member 60 which is similar to the embodiment shown in FIGS. 8A and 8B. The male engagement member 60 has a cross-sectional profile in a plane parallel to the second container housing 2, and the cross-sectional profile consists of a series of contiguous alternating peaks 61 and valleys 62. A corresponding female engagement member has a cross-sectional profile in a plane parallel to the first container housing, and the cross-sectional profile consists of a series of contiguous alternating peaks and valleys (not shown). The male engagement member 60 is different from the male engagement member 40 shown in FIG. 8A in that the body portion of the male engagement member 60 has a substantially triangular profile in a plane which comprises the longitudinal axis Y of the male engagement member and which is perpendicular to the second container housing 2. As shown in FIG. 12A, the profile has straight sides. FIG. 12B shows a cross-sectional view of the male engagement member 60 in engagement with the corresponding female engagement member. Because of the wavy design, a wavy pattern includes peaks and valleys in the plane which comprises the transverse axis along the length direction of the wavy sealing member compared with the linear sealing member known in the prior art. As mentioned above, this wavy configuration yields a number of benefits to the sealability.

Figure 13:
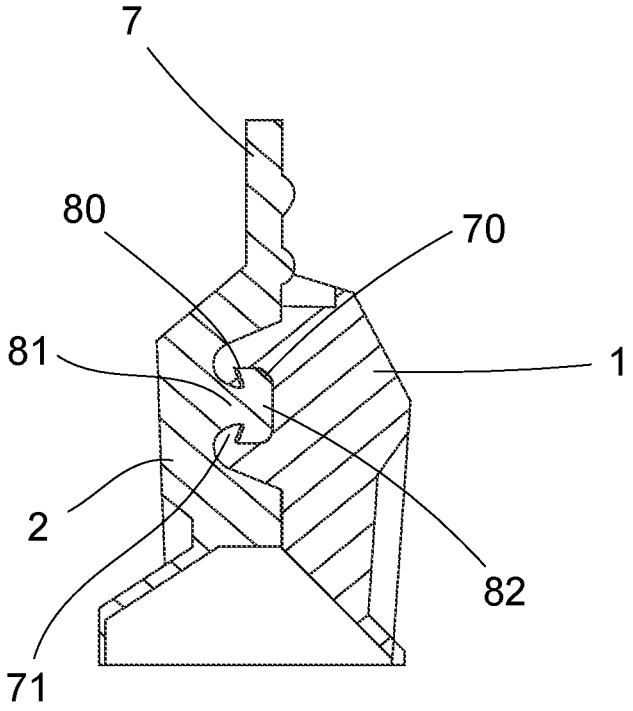
FIG. 13 is a schematic cross-sectional view of another alternative wavy male engagement member shown in FIG. 8A in engagement with its corresponding wavy female engagement member.

FIG. 13 shows a sealing mechanism of alternative embodiment in a similar cross-sectional view to FIG. 12B. The sealing mechanism shown in FIG. 13 comprises a male engagement member 80 which is substantially same structurally as the male engagement member 60 shown in FIGS. 12A and 12B. The male engagement member 80 have a cross-sectional profile in a plane parallel to the second container housing 2 and consists of a series of contiguous alternating peaks and valleys (not shown). The male engagement member 80 differs from the male engagement member 60 in that it has a body portion 81 terminated by a head 82 which forms together with the body portion 81 a T-shaped member. The T-shaped member has a substantially T-shaped profile in a plane which comprises the longitudinal axis of the male engagement member 80 and which is perpendicular to the second container housing 2. In order to facilitate insertion of the head 82 into a corresponding female engagement member 70, the head 82 is configured to have a chamfered outer side surface. In addition, the head 82 has an inner side surface extending at an acute angle with respect to the longitudinal axis of the male engagement member to define a hook. The hook is engageable with a snap-fit lobe 71 (refer to FIG. 13) of the female engagement member 70 for snap-fit engagement of the male engagement member 80 with the female engagement member 70. The similar wavy configuration of the male engagement member 80 and the female engagement member 70 provides an improved sealed engagement therebetween.

The bag container of the present invention is preferably a flexible container made of flexible materials which may comprise silicone or rubber. Silicone is a non-toxic polymer material that is resistant to high and low temperatures and is prone to molding and processing. The flexible bag container made of silicone is suitable for food storage. Particularly, it is preferred that the bag container discussed in the above embodiment is molded from silicone.

In addition, the bag container may be appropriately selected for its wall thickness depending on the volume of the container. The larger the volume, the greater the wall thickness of the container may have, which would make the container less likely to crack.

In the foregoing, exemplary embodiments have been described to illustrate the bag container with a sealing mechanism of the present invention in detail. It should be understood that the scope of the present invention is not limited to the above-mentioned embodiments, but is defined by the appended claims. Without departing from the objectives and spirit of the present invention, various modifications can be made to the embodiments, but they still fall within the scope of the present invention.

What is claimed is:

1. A bag container with a sealing mechanism, comprising a container body having a closable open top, a first container housing and a second container housing arranged opposite to the first container housing, each of the first container housing and the second container housing comprising a bottom edge and two side edges, wherein the first container housing is connected to the second container housing along the bottom edge and the two side edges to define an internal volume and the open top of the bag container, and a sealing mechanism provided atop the container body, comprising a female engagement member positioned at an inner surface of an upper portion of one of the first container housing and the second container housing, and a male engagement member positioned at an inner surface of an upper portion of the other, wherein each of the female engagement member and the male engagement member is configured to extend an entire length of the inner surface of the upper portion of the respective container housing, wherein the male engagement member comprises a body portion protruding outwardly from the inner surface of the upper portion of the container housing where the male engagement member is positioned, and the body portion of the male engagement member has at least one wavy section having a wavy cross-sectional profile in a first plane parallel to the container housing of the male engagement member, the cross-sectional profile comprising at least one peak or valley in a length direction of the body portion, wherein the body portion is configured to have a head and at least a pair of protrusions extending from opposite sides of the body portion and facing away from each other; and the head together with the pair of protrusions neighboring to the head define a substantially triangular profile in a second plane which comprises a longitudinal axis of the male engagement member and which is perpendicular to the first plane; and the female engagement member is shaped and sized to be matingly engageable with the male engagement member so that the upper portions of the first container housing and the second container housing are hermetically engageable with each other to seal the open top of the container body.

2. The bag container with a sealing mechanism according to claim 1, wherein the cross-sectional profile consists of a series of arcuate peaks between arcuate valleys to define the wavy cross-sectional profile.

3. The bag container with a sealing mechanism according to claim 1, wherein the wavy section extends an entire length of the body portion.

4. The bag container with a sealing mechanism according to claim 1, wherein the bag container is molded integrally.

5. The bag container with a sealing mechanism according to claim 4, wherein each of the two side edges of the first container housing and the second container housing consists of an integral molding portion and an unbonded portion, the integral molding portion extending from the bottom edge to between ⅕ and ⅘ of an overall height of the bag container, wherein the first and second container housings are molded along the integral molding portions thereof, and the first container housing and the second container housing are hermetically connected by bonding the unbonded portions thereof after the bag container is formed and demolded.

6. The bag container with a sealing mechanism according to claim 5, wherein the bonding comprises adhering the unbonded portions by an adhesive or hot melt treatment of the unbonded portions.

7. The bag container with a sealing mechanism according to claim 1, wherein each of the pair of protrusions has a first side surface facing the head and a second side surface opposite to the first side surface and facing away from the head, the second side surface extends at an acute angle with respect to an orthogonal direction perpendicular to a longitudinal axis of the male engagement member.

8. The bag container with a sealing mechanism according to claim 7, wherein the second side surface of the protrusion extends toward or away from the head of the body portion at an acute angle with respect to the orthogonal direction.

9. The bag container with a sealing mechanism according to claim 7, wherein the second side surface of the protrusion extends with respect to the orthogonal direction at the acute angle of 10°-30°.

10. The bag container with a sealing mechanism according to claim 1, wherein the male engagement member comprises at least two pairs of protrusions extending from the opposite sides of the body portion and facing away from each other.

11. The bag container with a sealing mechanism according to claim 1, wherein the bag container further comprises a grip portion atop the bag container.

* * * * *